US008530806B2

(12) United States Patent
Cetinel et al.

(10) Patent No.: US 8,530,806 B2
(45) Date of Patent: Sep. 10, 2013

(54) METHOD AND A DEVICE FOR REGULATING THE ELECTRICAL POWER SUPPLY TO A MAGNETRON, AND AN INSTALLATION FOR TREATING THERMOPLASTIC CONTAINERS BEING AN APPLICATION THEREOF

(75) Inventors: Ertan Cetinel, Octeville-sur-Mer (FR); Nicolas Chomel, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 1479 days.

(21) Appl. No.: 11/875,980

(22) Filed: Oct. 22, 2007

(65) Prior Publication Data

US 2008/0099472 A1 May 1, 2008

(30) Foreign Application Priority Data

Oct. 25, 2006 (FR) ..... 06 09379

(51) Int. Cl.
*H05B 6/68* (2006.01)

(52) U.S. Cl.
USPC ..... 219/704; 219/705; 219/708

(58) Field of Classification Search
USPC ..... 219/704–790, 506, 492; 428/36.7, 428/500, 515, 516, 408; 315/107
See application file for complete search history.

(56) References Cited

U.S. PATENT DOCUMENTS

| | | | | |
|---|---|---|---|---|
| 4,317,977 | A | 3/1982 | Buck | |
| 4,420,668 | A * | 12/1983 | Larson et al. | 219/718 |
| 4,433,232 | A * | 2/1984 | Tachikawa et al. | 219/502 |
| 4,447,693 | A | 5/1984 | Buck | |
| 4,939,330 | A * | 7/1990 | Berggren et al. | 219/716 |
| 6,828,696 | B2 | 12/2004 | Barry | |
| 6,919,114 | B1 | 7/2005 | Darras et al. | |
| 2006/0062931 | A1 | 3/2006 | Rius et al. | |

FOREIGN PATENT DOCUMENTS

| | | |
|---|---|---|
| EP | 0 252 889 A2 | 1/1988 |
| EP | 1 561 840 A1 | 8/2005 |
| FR | 2 776 540 A1 | 10/1999 |
| FR | 2 783 667 A1 | 3/2000 |
| FR | 2 792 854 A1 | 11/2000 |
| FR | 2 847 912 A1 | 6/2004 |
| JP | 56-63794 | 5/1981 |
| JP | 64-500233 | 1/1989 |
| JP | 2004-055308 | 2/2004 |
| JP | 2005-531914 | 10/2005 |

OTHER PUBLICATIONS

Office Action issued in JP 2007-277087, on Apr. 12, 2011, together with English translation of at least the pertinent portions.

* cited by examiner

*Primary Examiner* — Quang Van
(74) *Attorney, Agent, or Firm* — Suhgrue Mion, PLLC

(57) ABSTRACT

The electrical power supply to a magnetron (M) is regulated as a function of an instantaneous microwave power setpoint by: predetermining and storing (20) a value (η) for the electrical efficiency of the magnetron; inputting (19) a setpoint mean microwave power value, and converting it into a low frequency setpoint instantaneous power signal that is sampled at high frequency; measuring (8, 9) and sampling the instantaneous values of anode current and of the high voltage fed to the magnetron; calculating (10) the difference at a sampling instant (n) between the setpoint instantaneous microwave power and the product of the current multiplied by the high voltage multiplied by the efficiency; determining an instantaneous microwave power value at the consecutive sampling instant (n+1) that is corrected as a function of a predetermined regulation relationship that is valid at said instant (n+1); and converting it into an analog signal representative of the corrected instantaneous microwave power for powering the magnetron.

15 Claims, 3 Drawing Sheets

FIG.3.
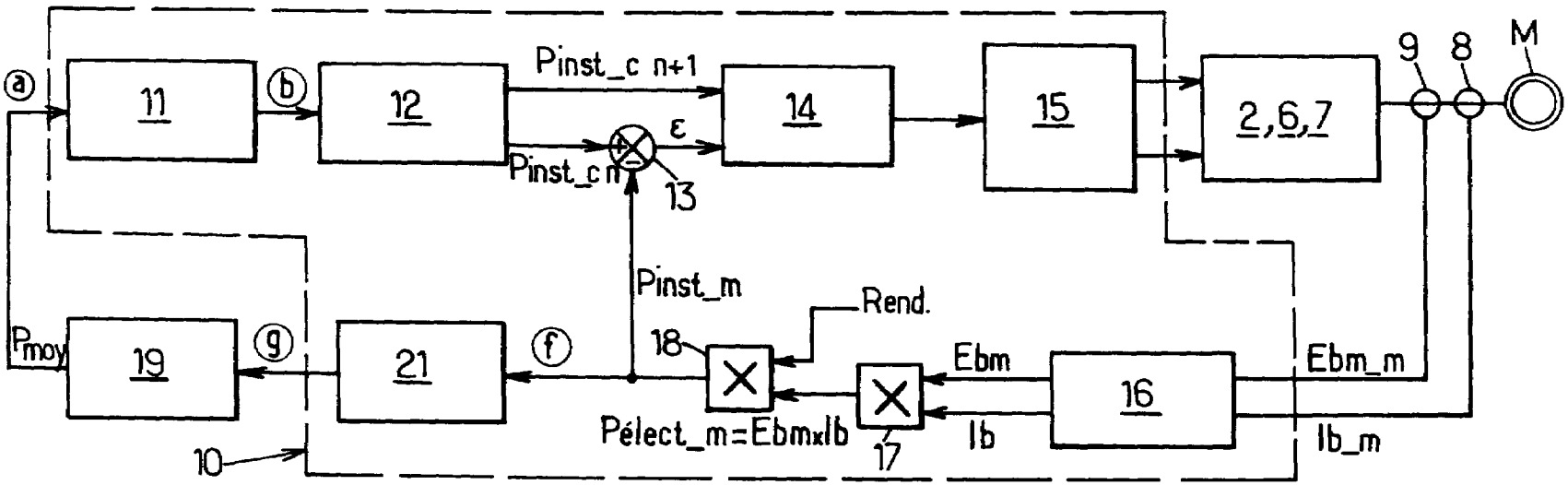
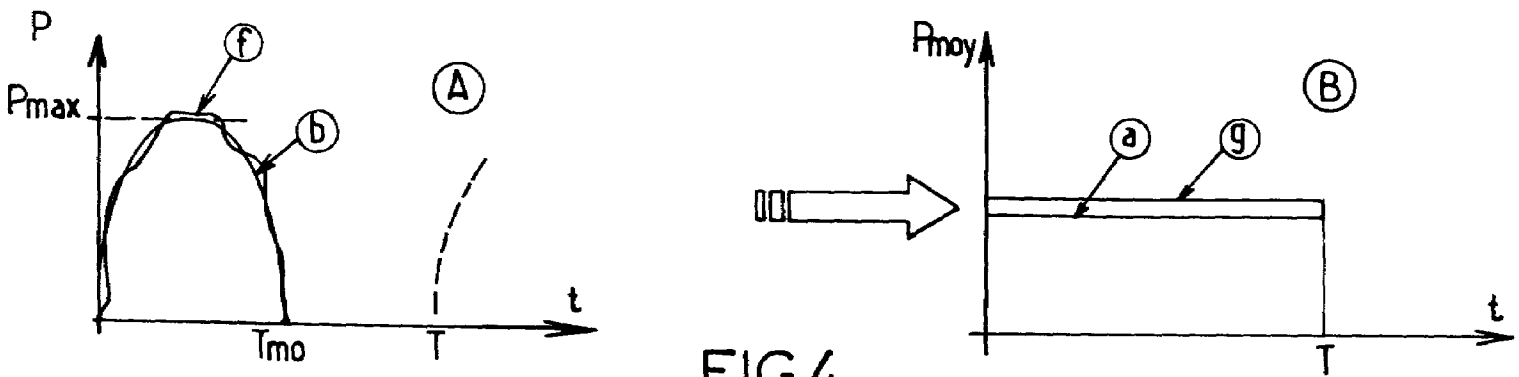
FIG.4.

METHOD AND A DEVICE FOR REGULATING THE ELECTRICAL POWER SUPPLY TO A MAGNETRON, AND AN INSTALLATION FOR TREATING THERMOPLASTIC CONTAINERS BEING AN APPLICATION THEREOF

FIELD OF THE INVENTION

The present invention relates to improvements provided in the field of regulating the electrical power supply to a magnetron forming part of means for generating ultra-high frequency (UHF) electromagnetic waves, with regulation being a function of a setpoint for instantaneous microwave power.

The improvements proposed by the invention have a preferred, although not exclusive, application in the field of depositing a coating, such as a barrier effect coating, on at least one face of a container of thermoplastic material with the help of a low pressure plasma, by exciting a precursor gas by means of electromagnetic waves lying in the UHF band within an evacuated cavity of cylindrical shape suitable for receiving said container, said UHF electromagnetic waves being emitted by a UHF wave generator comprising a magnetron possessing an anode, and electrical power supply means connected to said anode for feeding it with current at high voltage.

It is in this context that the invention is described more particularly, it being understood that the regulation of the electrical power supply to a magnetron as proposed by the invention can be implemented in other fields.

BACKGROUND OF THE INVENTION

Document FR 2 776 540 describes such a process of forming a barrier layer, and in particular documents FR 2 783 667, FR 2 792 854, and FR 2 847 912 describe various examples of devices enabling such a deposit to be made.

The person skilled in the art knows that in cold plasma methods, and in particular in the method known in the art as plasma enhanced chemical vapor deposition (PECVD), both the accuracy of the instantaneous microwave energy level that is emitted, and the waveform of the power emitted during the treatment cycle, constitute some of the main factors that enable coating deposition to present quality that is substantially constant, in other words that make it possible over time to obtain containers that are of substantially identical quality. A fortiori, in industrial installations for large capacity production having a multiplicity of deposition devices, it is important to control accurately the instantaneous microwave energy level delivered to all of the cavities in all of the devices of the installation in order to minimize differences in performance between devices within a single machine, or indeed between different machines, and thus differences in quality between containers processed respectively in a plurality of devices.

Various pieces of equipment are indeed known that are available for accurately adjusting such microwave energy levels (circulators, devices for measuring the real microwave power emitted, tuning stubs, . . . ). Nevertheless, such pieces of equipment are expensive, and thus difficult to envisage in an industrial installation where low cost price is of permanent concern; furthermore, such pieces of equipment are bulky and therefore difficult to install in an industrial machine, particularly when of the rotary type, which is already very cluttered with equipment and in which little space remains available; finally, effective and efficient implementation of equipment of that kind requires precise calibration adjustments that can be performed only by qualified personnel, not always available in industrial installations for mass production in which there is a constant concern for the technical means used to be simple to implement and operate.

Thus, in order to satisfy the requirement for reducing dispersion in the characteristics of the coating deposited on containers in a high-speed industrial process, it is necessary to find a specific and inexpensive solution for accurately controlling the operation of the magnetron.

It is reminded that a magnetron, which lies at the core of any system using microwaves, serves to transform an input high voltage (of several kilovolts (kV)) into an electromagnetic wave at a given ultra-high (microwave) frequency. The high voltage is delivered by a high voltage supply that is suitable for transforming a low voltage power supply (in particular at the voltage of a conventional electrical power supply network, e.g. 400 volts (V) three-phase) into a high voltage that is modulated as a function of the microwave energy desired at the output from the magnetron. For each model of magnetron, magnetron manufacturers provide basic curves serving to define the characteristics of the high voltage supply. Thus, for each model of magnetron, it is possible to obtain in particular a curve plotting variation in anode current as a function of emitted microwave power, a curve plotting variation in electrical efficiency as a function of the emitted microwave power, and a curve plotting variation in the high voltage to be applied to the magnetron as a function of the microwave power emitted.

The electrical efficiency of a magnetron is substantially stable for a given emitted microwave power and it varies little as a function of emitted microwave power (in a typical example of a magnetron, variation in electrical efficiency is of the order of 2.8% for emitted microwave power varying over the range 350 watts (W) to 900 W).

Nevertheless, all of those magnetron characteristics are valid only when the magnetron is coupled to a load that is said to be "matched", i.e. a load that does not reflect back towards the magnetron a fraction of the microwave energy that it receives therefrom.

Unfortunately, with devices of the kind to which the invention is more specifically intended, i.e. devices that are used for depositing a coating on a container of thermoplastic material with the help of a low pressure plasma by exciting a precursor gas with UHF electromagnetic waves in an evacuated cavity of cylindrical shape receiving said container, not only is the load coupled to the magnetron not matched, but in addition it does not remain constant over time, and it varies very quickly (over a period of the order of a few milliseconds). These variations in load are inherent to the conditions under which the plasma is formed in the cavity for a given emitted mean microwave power (operating conditions for the device as set by the operator as an operating setpoint):

- at the beginning of the process, the plasma is not yet established; the load coupled to the magnetron is poorly matched and it reflects a large amount of energy;
- thereafter the plasma becomes established within the cavity; the load coupled to the magnetron is matched better and it reflects less energy.

It is emphasized at this point that the mean power setpoint does not change between those two operating stages. The variations in the voltage and the current applied to the magnetron are associated solely with the behavior of the magnetron faced with varying amounts of reflected energy.

In an attempt to maintain the microwave power actually emitted by the magnetron at the setpoint value, it is known to implement anode current regulation: a proportionality coefficient is predetermined between anode current and emitted microwave power (where this characteristic can form part of the data provided by the manufacturer of the magnetron); in operation, the value of the anode current is measured continuously and a proportional correction is applied to the anode current as a function of variations in the load on the high voltage generator so as to maintain the microwave power emitted by the magnetron as constant as possible relative to the setpoint power.

The speed of power supply regulation is selected to be relatively slow (response time greater than 100 milliseconds (ms)), while the changeover from the strongly mismatched load condition to the better-matched load condition is very short and can correspond to one period of the high voltage (e.g. of the order of 10 ms to 20 ms). As a result, mainly during the start-up stage, the above-mentioned unbalance can extend over a plurality of high voltage pulses, with a large amount of unbalance in the power delivered by the high voltage power supply for the emitted microwave power being substantially analogous.

For a more concrete idea, FIG. 1 of the accompanying drawings is a graph showing the operation of a typical example of a magnetron and plotting as a function of time (along the abscissa, expressed in seconds), variation in the high voltage applied to the terminals of the magnetron (continuous line curve, plotted up the ordinate on the right-hand scale expressed in volts), and corresponding variation in regulated anode current under the above-mentioned conditions (dashed line curve plotted up the ordinate on the left-hand scale, expressed in milliamps).

It can be seen that for the group constituted by the first two cycles (to the left in the graph), the high voltage presents a lowest value of −3.6 kilovolts (kV); the percentage of energy reflected by the poorly matched load (the plasma is not yet established) is high. For the group constituted by the following cycles, the high voltage takes the value of −4 kV; the plasma is established, and the load is better matched, with a smaller percentage of energy being reflected.

The anode current applied to the generator is regulated relatively slowly, with a response time of the order of 40 ms. The instantaneous peak powers of the pulses PA (belonging to the group of first cycles) and of the pulses PB (belonging to the group of following cycles) are as follows:

- pulse PA: the anode current has a value of 360 milliamps (mA); the manufacturer of the magnetron gives a proportionality coefficient of 3 w of microwaves per milliamp, so the instantaneous microwave power delivered by the magnetron is 360×3, giving 1080 w; and
- pulse PB: the anode current has a value of 305 mA; the instantaneous microwave power delivered by the magnetron is 305×3, i.e. 915 W.

For the two pulses PA and PB shown in FIG. 1 as being the closest together during the changeover in operating conditions, it can be considered that, given the relative slowness with which the power supply is regulated, the internal parameters of power supply operation remain unchanged. The difference between the microwave power delivered by the magnetron, due to variation in the matching of the load coupled to the magnetron which continues to deliver mean microwave power that is substantially analogous in both circumstances, is about 15%, and is therefore very large.

As a result, the operating conditions of present devices fitted with high voltage power supplies using anode current regulation for the purpose of maintaining the microwave power emitted by the magnetron at a setpoint value are not optimized because the high voltage power supply is subjected to large and rapid variations in power.

SUMMARY OF THE INVENTION

An object of the invention is to provide improved means (method and device) that satisfy practical requirements better, and that make it possible, at little cost, in particular to improve and optimize the accuracy of the instantaneous microwave power emitted by the magnetron compared with the instantaneous setpoint power in a context where a rapidly varying level of microwave energy is reflected towards the magnetron.

For this purpose, in a first of its aspects, the invention provides a regulation method for regulating the electrical power supply to a magnetron as a function of an instantaneous microwave power setpoint, the magnetron forming part of means for generating UHF electromagnetic waves, which method, in accordance with the invention, is characterized in that it comprises the steps consisting in:

- previously determining and storing in memory at least one value for the electrical efficiency of the magnetron;
- inputting a setpoint mean microwave power value;
- converting said setpoint mean microwave power value to obtain a setpoint instantaneous power signal at low frequency;
- sampling said setpoint instantaneous power signal at a high sampling frequency;
- measuring and sampling the instantaneous values of anode current and high voltage fed to the magnetron;
- calculating the product of the instantaneous value of the anode current multiplied by the instantaneous value of the high voltage at said sampling instant, and multiplied by the previously determined value for the electrical efficiency of the magnetron, in order to obtain the instantaneous microwave power value as measured at said sampling instant;
- comparing said measured instantaneous microwave power value with the setpoint instantaneous power value sampled at a corresponding instant, and deducing therefrom a difference value at said sampling instant;
- from said difference value calculated at the sampling instant and from the setpoint instantaneous power value sampled at said immediately consecutive sampling instant, determining an instantaneous microwave power value at the immediately consecutive sampling instant that is corrected as a function of a predetermined regulation relationship valid at said immediately consecutive sampling instant; and
- performing power to electrical control magnitude conversion to obtain a corrected analog instantaneous microwave power signal suitable for controlling the power supply to the magnetron.

By implementing the dispositions in accordance with the invention, it is possible to reduce considerably the departure of the instantaneous power difference from the high voltage generator so that the emitted microwave power remains substantially analogous.

Returning to the numerical example mentioned above relating to the pulses PA and PB, the results obtained by implementing the method in accordance with the invention are as follows:

- pulse PA: for an anode current of 360 mA, a high voltage of −3550 V, and a mean magnetron electrical efficiency of 73.7% (a predetermined characteristic supplied by the manufacturer of the magnetron or previously measured), the instantaneous microwave power emitted by the magnetron is 942 w; and
- pulse PB: for an anode current of 305 mA, a high voltage of −4050 V, and a mean magnetron electrical efficiency of 73.7%, the instantaneous microwave power emitted by the magnetron is 910 W.

Thus, the difference in instantaneous microwave power emitted by the magnetron between the two pulses PA and PB is only 3.4% for a mean emitted microwave power level that is close. Implementing regulation in accordance with the invention makes it possible simply and at little expense to divide by four the operating power difference from the high voltage generator compared with merely regulating anode current as has been performed until now.

In addition, and in most advantageous manner, the dispositions in accordance with the invention are found to be particularly advantageously because of the high speed of response obtained thereby.

The dispositions in accordance with the invention can give rise to a variety of variants in regulation.

In a particular implementation of the method of the invention, power-to-frequency conversion is performed in order to control electrical power supply means using a resonant converter.

Because the electrical efficiency of the magnetron varies considerably as a function of the standing wave ratio, in order to determine the instantaneous power delivered to the magnetron, it is possible to make use of one or the other of the following solutions depending on operating conditions:

for a standing wave ratio that is relatively small and less than a given threshold value, the electrical efficiency of the magnetron is assumed to be constant, and the value measured by prior determination and stored in memory is the value for the mean electrical efficiency of the magnetron; or for a voltage standing wave ratio that is relatively high and above a predetermined threshold, correspondence is previously established and stored between pairs of measured values for instantaneous anode current and for instantaneous voltage applied to the magnetron and corresponding values of the electrical efficiency of the magnetron, and in operation, the instantaneous power is determined from the measured values of instantaneous anode current and of instantaneous voltage applied to the magnetron, and from the electrical efficiency value of the magnetron stored in the memory in correspondence with the pair of instantaneous values measured for the anode current and the voltage.

The method described above finds a particularly advantageous application when the magnetron emits UHF electromagnetic waves into an evacuated cavity that is substantially cylindrical in shape and suitable for receiving at least one container of thermoplastic material having a face on which a coating of a barrier material is deposited with the help of a low pressure plasma by exciting a precursor gas by means of said UHF electromagnetic waves.

In a second of its aspects, the invention provides a regulator device for regulating the electrical power supply to a magnetron of a UHF electromagnetic wave generator as a function of an instantaneous microwave power setpoint in order to implement the method in accordance with the invention, the device being characterized in that the regulator means comprise:

memory means for storing at least one previously determined value for the electrical efficiency of the magnetron; and a microcontroller comprising:

input means for inputting a setpoint mean microwave power value;

a converter unit suitable for converting said setpoint mean microwave power value into a setpoint instantaneous power signal at low frequency;

a sampler unit suitable for sampling said setpoint instantaneous power signal at a high sampling frequency;

measurement means and a sampler unit suitable for sensing and sampling the instantaneous values of anode current and of high voltage fed to the magnetron;

means arranged to calculate the product of the instantaneous value of the anode current at a sampling instant multiplied by the instantaneous value of the high voltage at said sampling instant, and multiplied by the previously determined value for the electrical efficiency of the instantaneous in order to determine the instantaneous microwave power value as measured at said sampling instant;

a comparator arranged to compare said measured instantaneous microwave power value with the setpoint instantaneous power value sampled at a corresponding instant and to deliver a difference value at said sampling instant;

means responsive to said difference value calculated at the sampling instant and to the setpoint instantaneous power value sampled at the immediately consecutive sampling instant, to determine an instantaneous microwave power value at the immediately consecutive sampling instant that is corrected as a function of a predetermined regulation relationship that is valid at said immediately consecutive sampling instant; and converter means for converting power into a controlling electrical magnitude suitable for converting the power into the electrical magnitude for controlling the corrected instantaneous microwave power value in order to obtain an analog signal representative of the corrected instantaneous microwave power and suitable for controlling the power supply to the magnetron.

Such a device can be arranged to implement a variety of regulation variants.

In one practical embodiment, the electrical power supply means are of the resonant converter type in which the resonant frequency is the controlling electrical magnitude and the means for converting power into the controlling electrical magnitude are power-to-frequency converter means.

In a simple embodiment suitable for being implemented when the standing wave ratio is relatively small and less than a predetermined threshold (e.g. typically less than about 2), the electrical efficiency of the magnetron is a predetermined constant value stored in memory.

In contrast, when the standing wave ratio is relatively high and greater than a predetermined threshold (e.g. typically greater than about 2), the device has memory means suitable for storing in memory correspondences between a plurality of pairs of values for magnetron anode current and for voltage across the terminals of the magnetron with a plurality of respective values for the electrical efficiency of the magnetron.

In a preferred embodiment, the electrical power supply means for the anode of the magnetron comprise a resonant chopper electrical power supply incorporating a bridge of power switches controlled in pairs respectively by two control units, together with a resonant filter mounted on a diagonal of said bridge of switches, and said power-to-frequency converter means have two outputs in phase opposition that are connected to respective ones of said two control units.

The above-described regulator device can be implemented in particularly advantageous manner in an installation for depositing a coating on a face of at least one container of thermoplastic material with the help of a low pressure plasma by exciting a precursor gas with UHF electromagnetic waves in an evacuated cavity of cylindrical shape receiving said container, said installation comprising a UHF wave generator and a UHF waveguide for connecting said generator to a window in the side wall of the cavity, said UHF wave generator comprising a magnetron possessing an anode, electrical power supply means connected to said anode to feed it with current at a power supply high voltage, and a regulator device for regulating the electrical power supply to the magnetron as a function of an instantaneous microwave power switch; in particular, the installation may be a rotary installation of the carousel type fitted with a multiplicity of treatment stations, each provided a magnetron that has its electrical power supply regulated in accordance with the invention.

BRIEF DESCRIPTION OF THE DRAWINGS

The invention can be better understood on reading the following detailed description of certain preferred embodiments given as purely illustrative examples. In the description, reference is made to the accompanying drawings, in which:

FIG. 3 is a block diagram of an embodiment of a microcontroller implemented in the FIG. 2 device; and FIG. 4 is a graph summarizing the mode of operation of the device of FIGS. 2 and 3.

DETAILED DESCRIPTION OF THE INVENTION

Figure 1:
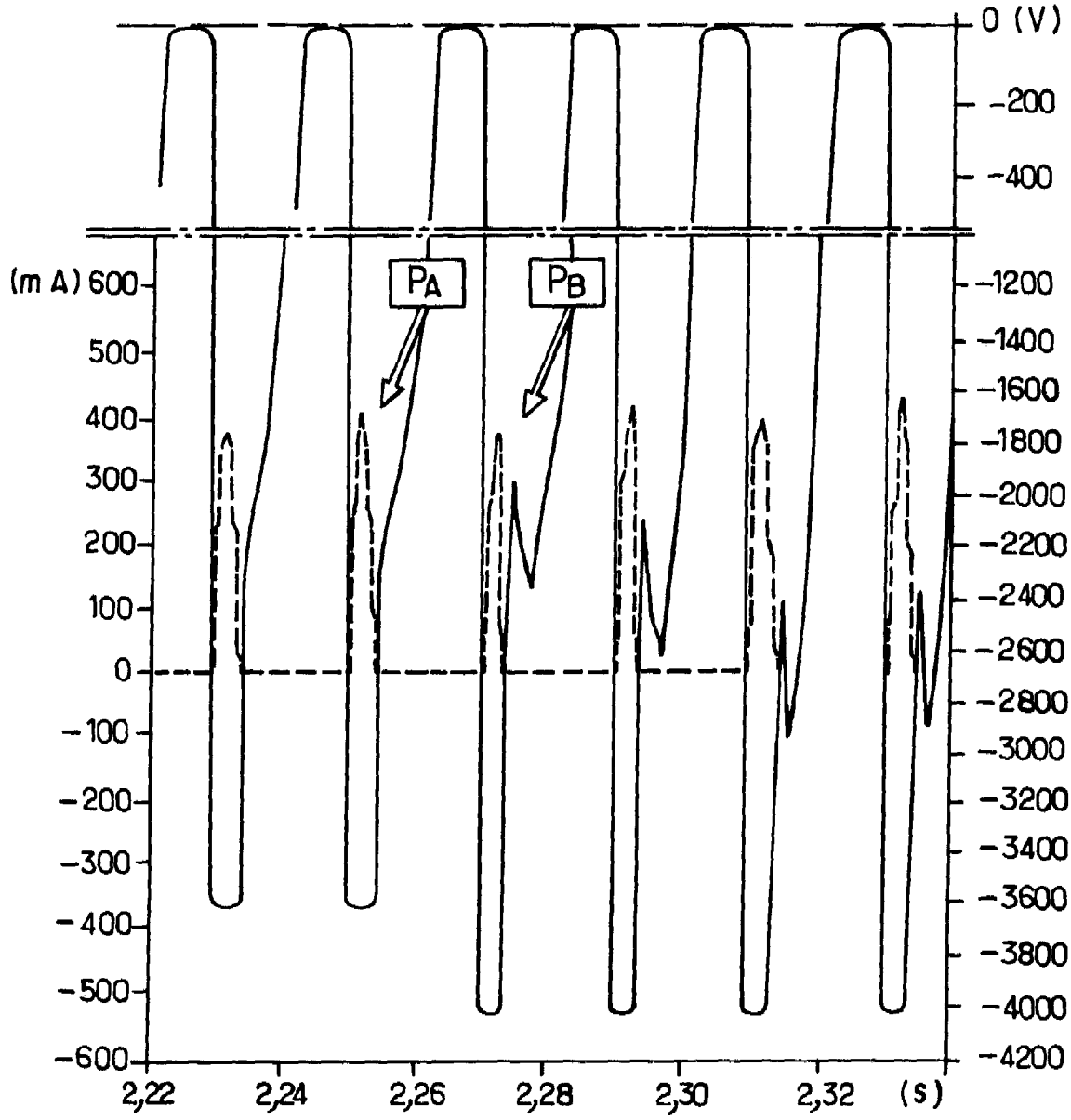
FIG. 1 is a graph characterizing the operation of a typical example of a magnetron and showing, as a function of time (plotted along the abscissa in seconds), variation in the high voltage (continuous line curve) across the terminals of the magnetron (plotted up the ordinate on the right-hand scale, expressed in volts) and corresponding variation in the anode current (dashed line curve) regulated under the conditions described above (plotted up the ordinate on the left-hand scale, expressed in milliamps)
Figure 2:
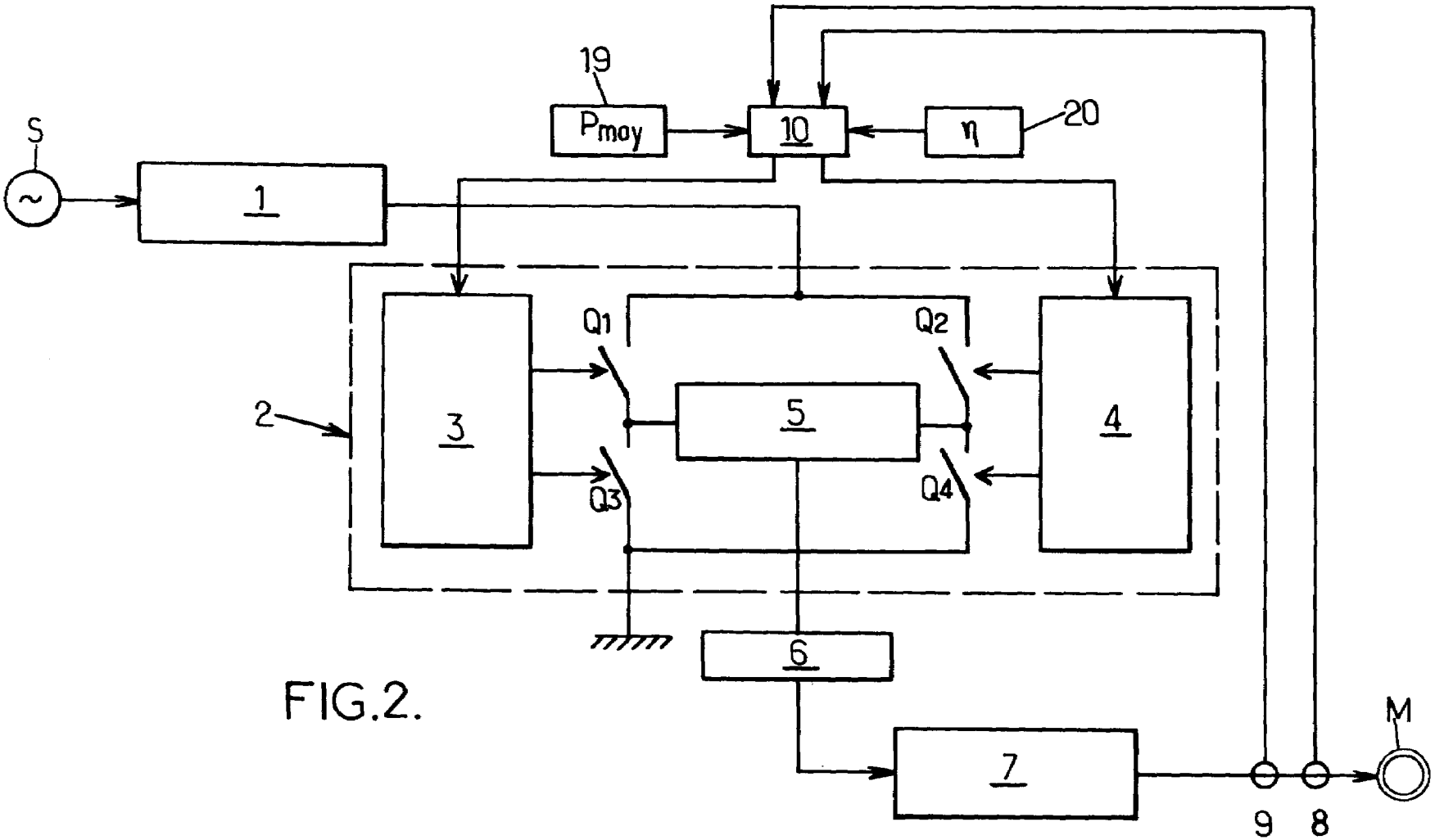
FIG. 2 is a simplified block diagram of a preferred embodiment of a high voltage power supply device for a magnetron implementing means in accordance with the invention.

Reference is now made initially to FIG. 2 which is a simplified block diagram of a preferred embodiment in accordance with the invention of a device for supplying high voltage to a magnetron, referenced M, from an electricity power supply which in practice may be a general alternating current (AC) electrical power supply network, typically a three-phase network operating at 400 V, and referenced S.

In general terms, the device is a power supply of the AC-AC type. For this purpose, the device comprises at its input a rectifier and filter stage that converts the alternating voltage into a voltage that has been rectified and smoothed, which voltage is applied to static type electrical power supply means 2 that may be of any appropriate structure for generating an alternating voltage.

In practice, it is preferable to have recourse to electrical power supply means 2 of the resonant converter type comprising, as shown, a set of four switches Q1 to Q4 (typically fast-switching transistors) connected in a bridge configuration together with two control units 3 and 4, each for controlling a respective pair of switches Q1 & Q3 or Q2 & Q4. A resonant filter 5 is connected across the diagonal of the bridge between Q1, Q3 on one side and Q2, Q4 on the other side.

The resonant filter 5 situated in the current branch of the converter is constituted by an association of inductors and capacitors having inductances and capacitances selected so as to obtain an optimum resonant frequency with an appropriate Q factor.

The operation of this type of power supply is known to the person skilled in the art and is summarized briefly below.

The resonant filter modulates the amplitude of the input signal. This variation in amplitude is a function of the characteristics of the components making up the filter and the frequency of the signal. It also changes the phase offset that exists between voltage and current. Amplitude is at a maximum when the frequency of the signal corresponds to the resonant frequency of the filter. It is attenuated as a function of the difference between the resonant frequency and the real frequency of the signal.

At the output from the resonant filter, an amplifier unit 6 picks up the very high frequency alternating voltage that is then amplified in amplitude in said amplifier unit 6. After rectification and smoothing in an output unit 7, situated downstream from the amplifier unit 6, the UHF power signal is applied to the anode of the magnetron M.

The regulation loop may comprise, at the output from the output unit 7, current measurement means 8 and voltage measurement means 9 constituted by known sensors that detect respectively the instantaneous value Ib of the anode current and the instantaneous value Ebm of the high voltage as delivered to the anode of the magnetron M.

Concerning the measurements of the anode current and of the voltage delivered to the magnetron, it is emphasized that these measurements may be taken as close as possible to the magnetron, as described, so as to measure the exact values of the electrical power supply to the magnetron. However, it is also possible for these measurements to be taken at other points of the circuit that are remote from the magnetron; under such circumstances, prior measurements are performed to establish a proportionality relationship between values measured at a remote point and the real values measured at the magnetron, and in operation use is made of values measured at a remote point as corrected by the predetermined proportionality relationships.

The current and high voltage measurement means 8 and 9 are connected to two respective inputs of a microcontroller 10, e.g. of the digital signal processor (DSP) type, having two outputs in phase opposition that are connected respectively to the control inputs of the units 3 and 4 for controlling the switches Q1 to Q4. The microcontroller 10 processes the anode current and high voltage values Ib and Ebm and manages power regulation by acting on the control units 3 and 4 that control the power switches Q1 to Q4 at high frequency, in particular by implementing a pulse width modulation technique.

The microcontroller 10 also receives, via a man-machine interface device 19, a power setpoint signal $P_{mean}$ (mean microwave power) as given by the operator and from which the desired instantaneous microwave power is established for the operation of the device.

Finally, memory means 20 connected to the microcontroller 10 store at least one predetermined electrical efficacy value η for the magnetron M.

The microcontroller 10 calculates the instantaneous power measured from the instantaneous measured values of anode current Ib and high voltage Ebm:

$$\text{measured instantaneous power} = Ib \times Ebm \times \text{magnetron electrical efficiency}$$

and then calculates the difference between the setpoint instantaneous microwave power and the measured instantaneous power.

Thereafter, on the basis of:

the setpoint instantaneous microwave power;

the calculated difference (possibly taking account of the difference determined during at least one earlier measurement); and a predetermined regulation relationship previously established and/or selected for obtaining the desired regulation (which regulation relationship may be of any suitable type, for example of the proportional integral derivative (PID) type that is input into the microcontroller; the microcontroller 10 issues a control signal to the units 3 and 4 for controlling the switches Q1 to Q4.

Returning to the numerical example mentioned above relating to the pulses PA and PB, the results obtained by implementing the dispositions of the invention are as follows:

pulse PA: for an anode current of 360 mA, a high voltage of −3550 V, and a mean magnetron electrical efficiency of 73.7% (predetermined characteristics supplied by the manufacturer of the magnetron or previously measured), the instantaneous microwave power for the magnetron is 942 W;

pulse PB: for an anode current of 305 mA, a high voltage of −4050 V, and a mean magnetron electrical efficiency of 73.7%, the instantaneous microwave power from the magnetron is 910 W.

The difference in magnetron power between the two pulses PA and PB is only 3.4% for a mean emitted microwave power level that is close. The magnetron thus operates under conditions in which its regularity is much better than in present devices.

FIG. 3 shows an advantageous concrete embodiment of the microcontroller 10.

The setpoint mean power $P_{mean}$ as input by the operator using the man-machine interface device 19 is processed by a converter unit 11 that converts it into a setpoint instantaneous power signal having a low frequency that can typically be of the order of 100 Hz. The setpoint instantaneous power signal is then digitized in a sampler unit 12. The sampling frequency may typically be of the order of 20 kHz, which leads to about 200 measurement points over one period T of the setpoint instantaneous power signal.

The sampler unit 12 is provided with two outputs delivering sample values from two consecutive sampling points n and n+1 respectively.

The output receiving the value Pinst_c at sampling point n is connected to one input (e.g. the +input) of a comparator 13, such as an algebraic comparator. The other input (the −input) of the algebraic comparator 13 receives the signal from a regulator loop that is set up as described below.

The measured instantaneous high voltage and instantaneous anode current signals Ebm_m and Ib_m are detected respectively by the above-mentioned measurement means 9 and 8 at the terminals of the magnetron M, and they are then sent to a sampler unit 16 for sampling these two signals. The corresponding sampled data, respectively Ebm and Ib, is applied to first multiplier means 17 delivering the measure instantaneous electrical power Pelect_m=Ebm×Ib, in other words the electrical power actually delivered to the magnetron.

This magnitude is in turn applied to an input of second multiplier means 18 having another input receiving data Eff concerning the efficiency of the magnetron M. The output signal from the second multiplier means 18 represents the measured instantaneous microwave power Pinst_m, in other words the power effectively transformed into microwave power by the magnetron. On the basis of the measured instantaneous microwave power Pinst_m, integrator means 21 are used to calculate the measured mean microwave power, which power is presented to the operator (via the man-machine interface device 19) to provide a visual comparison with the setpoint mean microwave power.

It is this measured instantaneous microwave power signal Pinst_m that is applied to the other input (in this case a negative input) of the above-mentioned comparator 13.

The output from the comparator 13 on which there appears the difference value ϵ between the setpoint and measured instantaneous microwave powers is connected to an input of an instantaneous power correction unit 14 with limits set to predetermined limit values, which unit 14 has a main input connected to the other output from the sampler unit 12 that delivers the value Pinst_c at point n+1. The correction unit 14 algebraically corrects the value Pinst_c at point n+1 with the difference value ϵ calculated at the sampling instant of point n, as a function of the setpoint instantaneous power value sampled at said immediately consecutive sampling instant, at point n+1, and as a function of the predetermined regulation relationship applicable at said sampling instant at point n+1.

The output from the correction unit 14 is connected to a converter unit 15 for converting power into a controlling electrical magnitude (where the controlling electrical magnitude is frequency in the described example of a resonant converter), which unit is appropriate for processing an approximately linear portion of the variation defined between frequency limit values F_max and F_min, forming part of the plot of power as a function of frequency centered on a value Fr: P0=f(Fr, F_min, F_max). Finally, the converter unit 15 for converting power to a controlling electrical magnitude delivers to the current branch a frequency signal as a function of time limited between the values F_min and F_max.

Finally, it is this signal output from the power to controlling electrical magnitude converter unit 15 that is delivered to the above-described power supply assembly (electrical power supply means 2, amplifier unit 6, output unit 7) that is connected to the magnetron M.

In summary, the regulation method for regulating the electrical power supply to the magnetron M as a function of an instantaneous microwave power setpoint comprises the following steps:

previously determining and storing in memory in the memory means 20 at least one value η for the electrical efficiency of the magnetron M;

inputting at 19 a setpoint mean microwave power value $P_{mean}$;

converting at 11 said setpoint mean microwave power value so as to obtain a setpoint instantaneous power signal at low frequency;

sampling said setpoint instantaneous power signal in the sampler unit 12 at a high sampling frequency;

using the measurement means 8, 9 and the sampling means 16 to measure the instantaneous values of anode current and high voltage fed to the magnetron;

the means 17, 18 are used to calculate the product of the instantaneous value of the anode current at sampling instant n multiplied by the instantaneous value of the high voltage at said sampling instant n, and multiplied by the previously determined value for the electrical efficiency of the magnetron in order to obtain the value of the instantaneous microwave power measured at said sampling instant n;

the comparator 13 compares this measured instantaneous microwave power value with the setpoint instantaneous power value sampled at a corresponding instant n, and a difference value E at said sampling instant n is deduced therefrom;

an instantaneous microwave power value at the immediately following sampling instant n+1 that is corrected as a function of the predetermined regulation relationship valid at said immediately consecutive sampling instant n+1 is determined from said difference value calculated at the sampling instant n, and from the setpoint instantaneous power value sampled at said immediately consecutive sampling instant n+1; and the converter means 15 for converting power to a controlling electrical magnitude serve to obtain an analog signal representative of the corrected instantaneous microwave power and suitable for controlling the power supply to the magnetron.

The above method can be implemented by the regulator device so as to regulate the electrical power supply to the magnetron as a function of an instantaneous microwave power setpoint, in which device the regulator means comprise: memory means 20 for storing at least one previously determined value for the electrical efficiency $\epsilon$ of the magnetron M; and a microcontroller 10, comprising:

- input means 19 for inputting a setpoint mean microwave power value $P_{mean}$;
- a converter unit 11 suitable for converting said setpoint mean microwave power value into a setpoint instantaneous power signal at low frequency;
- a sampler unit 12 suitable for sampling said setpoint instantaneous power signal at a high sampling frequency;
- measurement means 8, 9 and a sampler unit 16 suitable for picking up and sampling instantaneous values of anode current and of high voltage fed to the magnetron;
- means 17, 18 arranged to calculate the product of the instantaneous value of the anode current at a sampling instant n multiplied by the instantaneous value of the high voltage at said sampling instant n, and multiplied by the previously determined value of the electrical efficiency of the magnetron in order to determine the instantaneous microwave power value as measured at said sampling instant n;
- a comparator 13 arranged to compare said measured instantaneous microwave power value with the setpoint instantaneous power value sampled at a corresponding instant n and to deliver a difference value $\epsilon$ at said sampling instant n;
- means responsive to said difference value calculated at sampling instant n and from the setpoint instantaneous power value sampled at the immediately consecutive sampling instant n+1 to determine an instantaneous microwave power value at the immediately consecutive sampling instant n+1 that is corrected as a function of the predetermined regulation relationship valid at said immediately consecutive sampling instant n+1; and
- power converter means 15 for converting into an electrical control magnitude suitable for converting the power to the electrical control magnitude for the corrected instantaneous microwave power value in order to obtain an analog signal representative of the corrected instantaneous microwave power and suitable for controlling the power supply to the magnetron.

Thus, the magnetron M is fed with power that is regulated as a function of the power setpoint given by the user.

When a power supply used is of a type other than a resonant converter and in which some electrical magnitude other than frequency is controlled (e.g. current or phase) for control purposes, conversion is performed from power to that control electrical magnitude. The power that is delivered to the magnetron is thus regulated as a function of a power setpoint given by the user.

In FIG. 4, and with reference to FIG. 3, there can be seen two graphs that summarize the operation of the device arranged in accordance with the invention: graph A (instantaneous power plotted up the ordinate as a function of time plotted along the abscissa) shows the instantaneous setpoint power at (b) (output signal from the converter unit 11 in FIG. 3) and the measured regulated instantaneous microwave power at (f); graph B (means power plotted up the ordinate as a function of time plotted along the abscissa) shows the setpoint mean microwave power at (a) (input signal to the converted unit 11 in FIG. 3) and the measured mean microwave power at (g). Mathematically, the setpoint mean microwave power at (a) $P_{meana}$ (in practice the setpoint value delivered for running the process) is expressed as a function of the setpoint instantaneous power at (b), $P_b(t)$ as follows:

$$P_{meana} = \frac{1}{T}\int_0^T P_b(t).dt$$

while the measured mean microwave power at (g), $P_{meang}$ is expressed as a function of the regulated instantaneous microwave power at (f), $P_f(t)$, as follows:

$$P_{meanf} = \frac{1}{T}\int_0^T P_f(t).dt$$

It can clearly be seen that the difference between the two curves, one for setpoint power and the other for actual power, is very small.

In order for the implementation of the method of the invention to lead to regulation that is as accurate as possible, it is necessary for the value used for the electrical efficiency of the magnetron to be as accurate as possible. Unfortunately, this value can vary considerably depending on the operating conditions of the magnetron.

When the standing wave ratio (SWR) is relatively small (typically less than about 2), practically no energy is reflected by the load and almost all of the microwave energy is absorbed by the load. Under such circumstances, the electrical efficiency of the magnetron can be considered as being practically constant, and its value is determined by prior measurements. This is the value that is used and input into the above-mentioned second multiplier means 18.

In contrast, if the SWR is relatively large (typically greater than about 2), the microwave energy reflected by the load to the electrical power supply means 2 is relatively high and the electrical efficiency of the magnetron decreases considerably. More precisely, the electrical efficiency of the magnetron is associated with two magnitudes characteristic of its operating conditions, namely the level of microwave energy demanded and the SWR. For optimum implementation of the method of the invention, obtaining regulation that is as accurate as possible then requires use to be made of a value for the electrical efficiency of the magnetron that is no longer constant, but that is adapted to instantaneous operating conditions. Under such circumstances, prior tests are performed to determine an approximate value for the mean electrical efficiency of the magnetron for pairs of values of instantaneous voltage fed to the magnetron and anode current consumed by the magnetron (or of instantaneous power consumed by the magnetron). It is then possible to draw up a table of efficiency values or to establish a modeling equation that is input into the memory of the microcontroller 10. In operation, while performing regulation, the microcontroller calculates the emitted instantaneous power in two stages:

- firstly the instantaneous anode current and the voltage applied to the magnetron are measured, and the microcontroller determines the value of the electrical efficiency of the magnetron that corresponds to that pair of measured values (e.g. by looking up in a table or by using the modeling equation); and
- thereafter, the instantaneous power is determined from the pair of measured values and from the corresponding value determined for the electrical efficiency of the magnetron.

The advantage of the solution proposed lies in its very great simplicity and the great economy of means implemented that require no additional sensor or calculator means; since a microcontroller is already required for operating the installation in which the magnetron is included together with its regulated electrical power supply, and since measurements of the instantaneous anode current and of the instantaneous voltage applied to the magnetron are also required elsewhere, the only specific requirement lies in predetermining a table or a modeling equation giving various values for the electrical efficiency of the magnetron as a function of pairs of instantaneous current and voltage values, which, given the performance of current electronic equipment, does not constitute a constraint that is penalizing.

The dispositions in accordance with the invention can find a most advantageous application in an installation for depositing a coating on a face of at least one container of thermoplastic material using a low pressure plasma by exciting a precursor gas with UHF electromagnetic waves in an evacuated cavity of cylindrical shape that receives said container, said installation comprising a UHF wave generator and a UHF waveguide for connecting said generator to a window in the side wall of the cavity, said UHF wave generator comprising a magnetron M possessing an anode, means 2 for feeding it with electricity connected to said anode in order to feed it with current at a high voltage, and a regulator device for regulating the electrical power supply to the magnetron M as a function of an instantaneous microwave power setpoint. In practice, the installation may advantageously be a rotary carousel type installation fitted with a multiplicity of stations for treating containers, each station including a magnetron with its own regulated power supply.

What is claimed is:

1. A regulation method for regulating electrical power supply to a magnetron as a function of an instantaneous microwave power setpoint, the magnetron forming part of means for generating UHF electromagnetic waves, said method comprising:

storing, in a memory, at least one previously determined value $\eta$ for electrical efficiency of the magnetron, the electrical efficiency expressed as the microwave power divided by the electrical power supplied to the magnetron;

inputting a setpoint mean microwave power value $P_{mean}$;

converting said setpoint mean microwave power value to obtain a setpoint instantaneous microwave power signal having a first frequency;

sampling setpoint instantaneous microwave power values from the setpoint instantaneous microwave power signal at a plurality of sampling instants corresponding to a second sampling frequency which is higher than the first frequency;

measuring and sampling an instantaneous value of anode current and an instantaneous value of high voltage fed to the magnetron;

calculating a product of the instantaneous value of the anode current at a sampling instant n, the instantaneous value of the high voltage at said sampling instant n, and the previously determined value $\eta$ for the electrical efficiency of the magnetron, in order to obtain the instantaneous microwave power value as measured at said sampling instant n;

comparing said measured instantaneous microwave power value with the setpoint instantaneous microwave power value sampled at the sampling instant n, and deducing therefrom a difference value $\epsilon$ at said sampling instant n;

from said difference value at the sampling instant n and from the setpoint instantaneous microwave power value sampled at an immediately consecutive sampling instant n+1, determining an instantaneous microwave power value at the immediately consecutive sampling instant n+1 that is corrected in relation with a predetermined regulation relationship valid at said immediately consecutive sampling instant n+1; and converting a corrected instantaneous microwave power value to an electrical control magnitude signal to obtain a corrected analog instantaneous microwave power signal for controlling the electrical power supply to the magnetron.

2. A method according to claim 1, wherein said converting comprises:

converting the corrected instantaneous microwave power value to a frequency signal for controlling a resonant converter.

3. A method according to claim 1, wherein, for a standing wave ratio that is less than a given threshold value, the electrical efficiency of the magnetron is assumed to be constant and the value $\eta$ stored in the memory is the value for the mean electrical efficiency of the magnetron.

4. A method according to claim 1, wherein, for a standing wave ratio that is greater than a predetermined threshold, correspondence is previously established and stored between pairs of measured values for instantaneous anode current and instantaneous voltage applied to the magnetron, and for corresponding values for the electrical efficiency of the magnetron, and wherein, in operation, the instantaneous microwave power value is determined from the measured values for the instantaneous anode current and the instantaneous voltage applied to the magnetron and from the value for the electrical efficiency of the magnetron stored in the memory in correspondence with the pair of measured instantaneous values for the anode current and the voltage.

5. A method according to claim 1, wherein the magnetron emits UHF electromagnetic waves into an evacuated cavity of cylindrical shape suitable for receiving at least one container of thermoplastic material having a face on which a coating of a barrier material is to be deposited with the help of a low pressure plasma by exciting a precursor gas with said UHF electromagnetic waves.

6. A regulator device for regulating an electrical power supply to a magnetron of a UHF electromagnetic wave generator as a function of an instantaneous microwave power setpoint, the regulator device comprising:

a memory which stores at least one previously determined value for electrical efficiency $\eta$ of the magnetron, the electrical efficiency being expressed as the microwave power divided by the electrical power supplied to the magnetron; and a microcontroller comprising:

an input device configured to be input a setpoint mean microwave power value $P_{mean}$;

a converter unit configured to convert said setpoint mean microwave power value into a setpoint instantaneous microwave power signal at a first frequency;

a first sampler unit configured to sample setpoint instantaneous microwave power values from the setpoint instantaneous microwave power signal at a plurality of sampling instants corresponding to a second sampling frequency which is higher than the first frequency;

a measurement unit and a second sampler unit configured to sense and sample, respectively, an instantaneous value of anode current and an instantaneous value of high voltage fed to the magnetron;

a calculator configured to calculate a product of the instantaneous value of the anode current at a sampling instant n, the instantaneous value of the high voltage at said sampling instant n, and the previously determined value for the electrical efficiency η of the magnetron in order to determine the instantaneous microwave power value as measured at said sampling instant n;

a comparator configured to compare said measured instantaneous microwave power value with the setpoint instantaneous microwave power value sampled at the sampling instant n and to determine a difference value (ϵ) at said sampling instant n;

a correction unit configured to receive said difference value calculated at the sampling instant n and the setpoint instantaneous microwave power value sampled at an immediately consecutive sampling instant n+1, and to determine an instantaneous microwave power value at the immediately consecutive sampling instant n+1 that is corrected in relation with a predetermined regulation relationship that is valid at said immediately consecutive sampling instant n+1; and a converter configured to convert a corrected instantaneous microwave power value into a controlling electrical magnitude signal to obtain an analog signal representative of the corrected instantaneous microwave power value for controlling the electrical power supply to the magnetron.

7. A device according to claim 6, further comprising:

a resonant converter which supplies the electrical power to the magnetron, wherein the controlling electrical magnitude signal comprises a resonant frequency signal, and the converter is a power-to-frequency converter.

8. A device according to claim 6, wherein, for a standing wave ratio being less than a given threshold value, the electrical efficiency of the magnetron is assumed to be constant, and the memory stores a previously determined value for the mean electrical efficiency of the magnetron.

9. A device according to claim 6, wherein, for a standing wave ratio being greater than a predetermined threshold, and for a plurality of electrical efficiency values for the magnetron being determined in correspondence with an identical plurality of pairs of respective measured values for instantaneous anode current and instantaneous voltage applied to the magnetron, the memory stores said plurality of electrical efficiency values of the magnetron in correspondence with said identical plurality of pairs of respective measured values of instantaneous anode current and of instantaneous voltage applied to the magnetron.

10. A device according to claim 6, further comprising:

a resonant chopper electrical power supply which supplies the electrical power to the magnetron and comprises:

a bridge of power switches controlled in pairs by two respective control units, and a resonant filter connected along a diagonal of said bridge of power switches, and wherein the converter comprises a power-to-frequency converter which has two outputs in phase opposition that are connected respectively to said two control units.

11. An installation for depositing a coating on at least one face of a container of thermoplastic material with the help of a low pressure plasma by exciting a precursor gas with UHF electromagnetic waves in an evacuated cavity of cylindrical shape receiving said container, the installation comprising:

a UHF wave generator and a UHF waveguide for connecting said generator to a window in the side wall of the cavity, said UHF wave generator comprising a magnetron possessing an anode, electrical power supply being connected to said anode in order to feed said anode with current at a high power supply voltage, and a regulator device which regulates the electrical power supply to the magnetron as a function of an instantaneous microwave power setpoint, wherein said regulator device comprises a memory which stores at least one previously determined value for the electrical efficiency η of the magnetron, the electrical efficiency being expressed as the microwave power divided by the electrical power supplied to the magnetron; and a microcontroller comprising:

an input device configured to be input a setpoint mean microwave power value $P_{mean}$;

a converter unit configured to convert said setpoint mean microwave power value into a setpoint instantaneous microwave power signal at a first frequency;

a first sampler unit configured to sample setpoint instantaneous microwave power values from the setpoint instantaneous microwave power signal at a plurality of sampling instants corresponding to a second sampling frequency which is higher than the first frequency;

a measurement unit and a second sampler unit configured to sense and sample, respectively, an instantaneous value of anode current and an instantaneous value of high voltage fed to the magnetron;

a calculator configured to calculate a product of the instantaneous value of the anode current at a sampling instant n, the instantaneous value of the high voltage at said sampling instant n, and the previously determined value for the electrical efficiency η of the magnetron in order to determine the instantaneous microwave power value as measured at said sampling instant n;

a comparator configured to compare said measured instantaneous microwave power value with the setpoint instantaneous microwave power value sampled at the sampling instant n and to determine a difference value (ϵ) at said sampling instant n;

a correction unit configured to receive said difference value calculated at the sampling instant n and the setpoint instantaneous microwave power value sampled at an immediately consecutive sampling instant n+1, and to determine an instantaneous microwave power value at the immediately consecutive sampling instant n+1 that is corrected in relation with a predetermined regulation relationship that is valid at said immediately consecutive sampling instant n+1; and a converter configured to convert a corrected instantaneous microwave power value into a controlling electrical magnitude signal to obtain an analog signal representative of the corrected instantaneous microwave power value for controlling the electrical power supply to the magnetron.

12. The installation according to claim 11, wherein said regulator device further comprises a resonant converter which supplies the electrical power to the magnetron, wherein the controlling electrical magnitude signal comprises a resonant frequency signal, and the converter comprises a power-to-frequency converter.

13. The installation according to claim 11, wherein, for a standing wave ratio being relatively small and less than a given threshold value, the electrical efficiency of the magnetron is assumed to be constant, and the memory stores a previously determined value for the mean electrical efficiency of the magnetron.

14. The installation according to claim 11, wherein, for a standing wave ratio being relatively high and greater than a predetermined threshold, and for a plurality of electrical efficiency values for the magnetron being determined in correspondence with an identical plurality of pairs of respective measured values for instantaneous anode current and instantaneous voltage applied to the magnetron, the memory stores plurality of electrical efficiency values of the magnetron in correspondence with said identical plurality of pairs of respective measured values of instantaneous anode current and of instantaneous voltage applied to the magnetron.

15. The installation according to claim 11, wherein said regulator device further comprises:

a resonant chopper electrical power supply which supplies the electrical power to the magnetron and comprises:

a bridge of power switches controlled in pairs by two respective control units, and a resonant filter connected along a diagonal of said bridge of switches, wherein the converter comprises a power-to-frequency converter which has two outputs in phase opposition that are connected respectively to said two control units.

* * * * *